United States Patent [19]

Eckel

[11] Patent Number: 4,612,731

[45] Date of Patent: Sep. 23, 1986

[54] GRINDING MACHINE

[75] Inventor: Merowech Eckel, Klagenfurt, Austria

[73] Assignee: U.S. Philips Corporation, New York, N.Y.

[21] Appl. No.: 622,504

[22] Filed: Jun. 20, 1984

[30] Foreign Application Priority Data

Jun. 24, 1983 [AT] Austria ..... 2328/83

[51] Int. Cl.[4] ..... B24B 3/36

[52] U.S. Cl. ..... 51/56 R; 51/109 BS; 51/128

[58] Field of Search ..... 51/109 BS, 128, 56 R, 51/285, 208, 165.8

[56] References Cited

U.S. PATENT DOCUMENTS

| | | | |
|---|---|---|---|
| 730,706 | 6/1903 | Rose | 51/128 |
| 2,114,106 | 4/1938 | Geveke | 51/208 X |
| 2,332,609 | 10/1943 | Simons | 51/165.8 X |
| 3,412,508 | 11/1968 | Schell, Jr. | 51/128 X |
| 4,069,619 | 1/1978 | Escamilla | 51/128 X |

*Primary Examiner*—Frederick R. Schmidt
*Assistant Examiner*—Debra S. Meislin
*Attorney, Agent, or Firm*—Rolf E. Schneider

[57] ABSTRACT

Apparatus for sharpening knives, scissors, and the like comprises a housing forming an enclosure having two oppositely disposed walls each provided with an opening, such openings being coaxially aligned. A motor is mounted on the outer side of one of these oppositely disposed walls, the motor having a shaft extending through the opening in the one wall into the enclosure. A second shaft extends through the opening in the other oppositely disposed wall. A grinding wheel is fastened to the end of the second shaft positioned outside the enclosure. Provision is made for connecting the motor shaft to the other end of the second shaft to rotatably drive the second shaft and to enable axial movement of the motor shaft and the second shaft with respect to each other. A pair of axially spaced radial flanges is mounted on the second shaft within the enclosure. A pair of axially spaced strip-shaped leaf springs cooperates with the radial flanges and is attached to the enclosure internally thereof, one of the leaf springs being in contact with one of the radial flanges when the grinding wheel is in its inoperative position. A cover is associated with the housing and is provided with a guide passage for drawing through a knife or the like into contact with the grinding wheel, the knife or the like when drawn through said guide passage exerting pressure on the grinding wheel and thereby moving the second shaft axially in one direction, a leaf spring, following the drawing of the knife or the like through such guide passage, axially moving the second shaft in the opposite direction.

4 Claims, 2 Drawing Figures

GRINDING MACHINE

This invention relates to a grinding machine or sharpener for scissors, knives, etc., in which at least one grinding wheel fastened to a shaft which can be slid in either axial direction by means of a motor is positioned by a spring force acting in both axial directions in an idle position out of which it can be slid in an axial direction by the action of a lateral grinding pressure.

In a grind machine or apparatus of this kind as known from U.S. Pat. No. 2,114,106, two adjacent grinding wheels are interference-fitted on to a shaft, on which, additionally, two helical springs are fitted, each of which presses against the side of one of the two grinding wheels, so that the two grinding wheels are positioned on the shaft in an idle position from which they can be shifted under the action of a sidewise grinding pressure. The shaft for its part has a drilled axial hole by means of which it is slid on to the motor shaft, a pin-and-slot connection between the two shafts being provided for transmission purposes, so that the shaft carrying the two grinding wheels can be slid in either axial direction on the motor shaft. A construction of this kind is relatively costly and has various other disadvantageous because the idle position of the two grinding wheels is not unambiguously determined since the shaft carrying the grinding wheels is freely movable on the motor shaft because of the pin-and-slot connection and because the grinding wheels are only carried around because of their interference fit on the shaft, which only permits a limited power transmission.

The object of the present invention is to design a grinding machine of the kind referred to above in such a way that, using constructionally simple means, unambiguous positioning of at least one grinding wheel in an idle or in operative position is obtained, from which it can be shifted in defined fashion in either axial direction against spring force, depending on the direction in which a sidewise grinding pressure is exerted on the grinding wheel, being otherwise subject to no limitation arising from slippage in relation to a drive element. To that end, according to the invention, precautions are taken to ensure that the grinding wheel is fixed rigidly to the shaft, that the shaft has, located or spaced a certain distance from each other, rotation surfaces suitable for the take-up of the spring action in either of the two axial directions and that, for the application of the spring action to the two rotation surfaces, at least one fixed strip-shaped leaf spring is provided, which spring rests with at least one side surface of its free end laterally beside and in one of the two axial directions behind one of the two rotation surfaces. As can be seen, this is a simple means of ensuring "slidability" in both directions, against spring action, of the grinding wheel, together with the shaft which carries it, and also unambiguous positioning of the grinding wheel in an idle position, and of ensuring that the grinding-wheel drive is obtained without possible slippage. It should be mentioned at the same time that there are, of course, known methods, as published German application OS No. 2,936,892, for example, shows, of fixing a grinding wheel to a drive shaft, but in which no provision is made for "slidability" of the grinding wheel against spring action in both directions.

For positioning of the grinding wheel in its idle position it is possible to ensure that this is done in both directions under constant spring action and that, even with the grinding wheel in its idle position, a side surface of a free end of a leaf spring is held with pre-tensioning against each of the two rotation surfaces. It has, however, proved advantageous to position the grinding wheel in its idle position with a limited degree of play, the side surface of a free end of a leaf spring being spaced from a rotation surface, doing so without contact pressure against that rotation surface. The idle position of the grinding wheel is also defined by this arrangement and the lateral grinding pressure on the grinding wheel in either axial direction is also opposed by a corresponding spring action, but with the additional result that, with the grinding wheel in its idle position, no additional frictional load is exerted on the driving device, i.e. the motor of the grinding machine, which is particularly advantageous when the motor used is a self-starting single-phase synchronous motor, in which, as is well known, it is important for reliable starting that the latter should be done with the least possible load.

To apply the spring action in either axial direction to the two rotation surfaces a single leaf spring can be provided, the two side surfaces of whose free end each cooperate with one of the two rotation surfaces formed opposite each other, which basically yields a very simple design. With a view to particularly greater reliability, however, it has proved advantageous to have two strip-shaped leaf springs, each of which is around with a side surface of its free end laterally beside and in one of the two axial directions behind one of the two rotation surfaces.

In this connection it has also proved advantageous with regard to very simple construction if the two leaf springs are formed by the two limbs of a U-shaped strap, whose middle section is fastened to the apparatus housing.

There are various possibilities with regard to the method of forming the two rotation surfaces. For example, they can be formed by the side surfaces of an annular groove on the shaft. It has, however, proved particularly advantageous if the two rotation surfaces are each formed by a side surface of at least one flange fitted to the shaft. There is thus no weakening of the shaft carrying the grinding wheel and there is sufficient room available for the cooperation of a side surface of a free end of a leaf spring with the rotation surface concerned.

The invention will now be further explained with reference to the accompanying drawing, in which.

Figure 1:
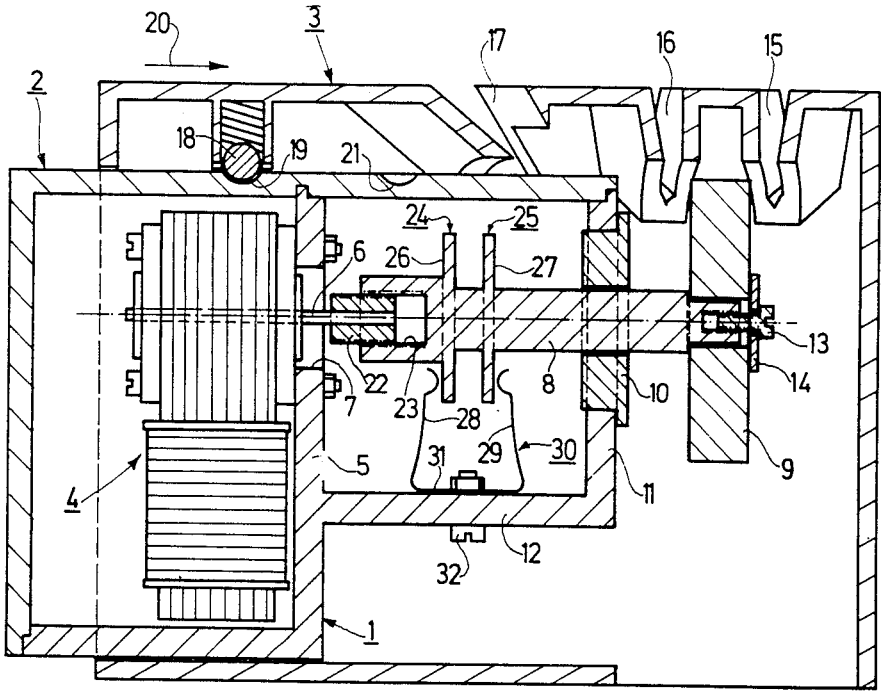
FIG. 1 shows a longitudinal sectional view, with parts not in section,through a grinding machine, in which the two limbs of a U-shaped strap form two leaf springs with respect to which a grinding wheel permanently fixed to a shaft is positioned in an idle position.

The grinding machine shown in FIG. 1 incorporates a part 1 which, together with a shell-type part 2 which is placed on it and fastened to it in a manner not further illustrated, forms a basic housing on which a cover 3 can be slid. The drive motor 4, of the grinding machine is fastened to a wall 5 of part 1, e.g. by means of screwed connections, the motor shaft 6 protruding through an opening 7 in wall 5. This motor shaft 6 is connected, in such a way as to drive it, to a second shaft 8 which carries at one end the grinding wheel 9, which is permanently fixed to shaft 8. It would, of course, be basically possible to fit two or more grinding wheels for various grinding purposes successively on shaft 8. Shaft 8 also runs coaxially with the motor shaft in a bearing bush 10 in another wall 11 of part 1. Wall 11 of part 1 is parallel to wall 5 and is connected to it by another wall section 12. The grinding wheel 9 is placed on the end of shaft 8 projecting from wall 11 and is connected frictionally to shaft 8, for example by means of a screw 13 coaxial with the shaft and a clamping disc 14, so that by unscrewing screw 13 it is also possible to replace grinding wheel 9 easily when the need arises.

In order to give a perfect edge to objects such as knives, scissors, etc. to be ground, a grinding machine of this kind is generally provided with guide passages for these objects, into which the latter are inserted and drawn through, in which process they are brought into operating contact with the grinding wheel at a certain grinding angle. In the present embodiment these guide passages are formed in the cover 3; in all there are three guide passages 15, 16 and 17. In the position of the cover 3 shown in the drawing, which position is determined, for example, by a ball stop, a ball 18 is subjected to a spring force and engages a cavity 19 in part 2, the guide passages 15 and 16 being located in the area of grinding wheel 9 on either side thereof. Optionally, therefore, either side of a cutting edge can be ground, depending on which of the two guide passages the object to be ground is drawn through. These guide passages 15 and 16 will, for example, be used if it is desired to sharpen a knife. If cover 3 is shifted in the direction of the arrow 20 until ball 18 of the ball stop engages cavity 21 in part 2 of the housing, guide passage 17 will be in the vicinity of grinding wheel 9. This guide passage 17 is more flatly inclined so that it is particularly suitable for the sharpening of scissors. Within the framework of the present state of the art a range of possibilities exists for the design of such guide passages.

A requirement for ensuring a uniformly perfect grind is that the object to be ground should not be pressed too firmly against the grinding wheel and therefore that the grinding pressure should not exceed a predetermined value. When the object to be ground is applied laterally to the grinding wheel, the latter must therefore be capable of moving away in the axial direction against a spring pressure when the contact pressure is too great. When both sides of the grinding wheel are used in turn for grinding, the grinding wheel must accordingly be made slidable in both axial directions against the spring force. Without grinding pressure on the grinding wheel, the grinding wheel must be positioned in a predetermined idle position such that it occupies the correct position in relation to the guide passages.

In order to ensure such slidability in both axial directions of grinding wheel 9 fitted integrally to shaft 8, the latter is not only rotatable but also slidable in bearing bush 10 while, additionally, its drive connection with motor shaft 6 is designed so that the latter also permits sliding in both axial directions. In the present case the latter object is achieved by having on the motor shaft 6 a pinion 22 which engages with its toothing in a corresponding internal toothing on coaxial hole 23 in shaft 8. The rotary movement of pinion 22 is thus transmitted to shaft 8 and the latter can be slide in both axial directions in relation to pinion 22. There are, of course, other possibilities for the design of such a drive connection, e.g. in the form of a pin-slot connection.

Shaft 8 is additionally fitted with two collars or flanges 24 and 25, axially spaced some distance from each other. The side surfaces of these flanges form radial rotation surfaces which are intended to take up spring action, each in one of the two axial directions, to which end, in the present embodiment, the rotation surfaces designated 26 and 27, which are the side surfaces of the two flanges turned away from each other, are utilised. To apply the spring action to the two rotation surfaces 26 and 27 in the present case two strip-shaped leaf srings 28 and 29, fixed to the consisting wall 12, are used, each of which is arranged with one side surface of its free end laterally beside and, in one of the two axial directions, behind one of the two rotation surfaces 26 and 27. With this arrangement it can be seen that, on the one hand, the side surface of the free end of leaf spring 28 facing rotation surface 26 lies behind rotation surface 26 in the axial direction of motor 4, and, on the other, the side surface of the free end of leaf sring 29 facing rotation surface 27, lies behind rotation surface 27 in the axial direction of grinding wheel 9. In the embodiment considered here the free ends of the two leaf springs 28 and 29 are bent to a semi-circular shape in order to ensure a particularly reliable cooperation with the relevant rotation surface 26 or 27.

The two leaf springs 28 and 29 thus position shaft 8 and hence also grinding wheel 9 in a predetermined idle position by grasping the two collars 24 and 25 from outside, namely from their rotation surfaces 26 and 27, and clamping them between themselves. If grinding wheel 9 is shifted together with shaft 8 in one of the two axial directions by a lateral grinding pressure, that one of the two leaf springs 28 and 29 which is located behind the particular rotation surface 26 or 27 comes into action. This means that one or the other of springs 26 and 27 always opposes the lateral grinding pressure on the grinding wheel in one or the other axial direction. It can be seen that both positioning of the grinding wheel in its operating position and the creation of a counterforce to a lateral grinding pressure on the grinding wheel in either axial direction are achieved in a particularly simple manner. Since, at the same time, grinding wheel 9 is fixed solidly to shaft 8, power transmission to the grinding wheel takes place without any possible slippage which is desirable for the grinding process itself in connection with the required grinding forces.

In the present embodiment the two leaf springs 28 and 29 are formed by the two limbs of the U-shaped strap 30, whose centre section 31 is fastened connecting wall 12, e.g. by a screwed connection 32. This type of spring design has proved particularly simple and effective. Strap 30 could obviously be fastened to the housing in a different manner, e.g., by a clamped connection. It would, of course, also be possible to design the two leaf springs 28 and 29 as separate parts which would then be fastened separately to the housing.

As can be seen from FIG. 1, the two leaf springs 28 and 29 in the present example of embodiment position grinding wheel 9 together with shaft 8 in the idle position with a certain amount of play, the side surfaces of the free ends of the two leaf springs 28 and 29, which surfaces are located laterally beside the two rotation surfaces 26 and 27, not exerting any contact pressure on the rotation surfaces 26 and 27. This ensures that when motor 4 is connected to the power supply, i.e. when the grinding machine is switched on, springs 28 and 29 do not cause any additional load by friction against rotation surfaces 26 and 27. This is particularly advantageous if a self-starting single-phase synchronous motor is used for motor 4, since, as is generally known, a motor of this kind should be subjected to as little load as possible when starting in order to ensure a reliable start. If this requirement is not specified, springs 28 and 29 can, of course, rest with the side surfaces of their free ends, even when grinding wheel 9 and shaft 8 are in their idle position, against rotation surfaces 26 and 27 with pre-tension, i.e. with a predetermined contact pressure, the positioning of the grinding wheel and the desired idle position being then particularly reliably effected.

Figure 2:
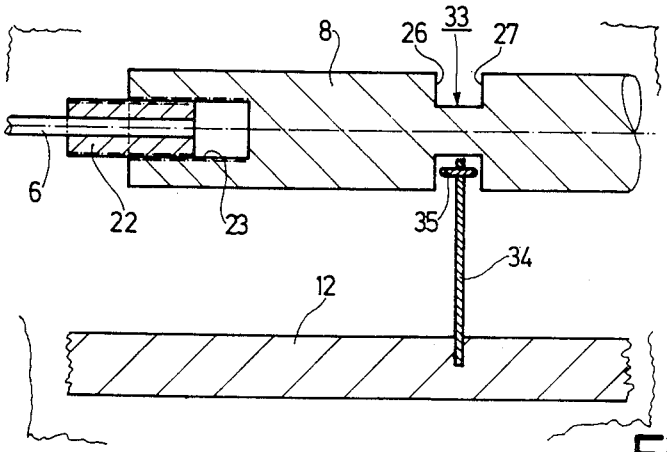
FIG. 2 shows a partial sectional view on an enlarged scale of a grinding machine which is designed similarly to that in FIG. 1 but in which a single leaf spring is used to position a grinding wheel permanently fixed to a shaft.

As already stated, the two rotation surfaces 26 and 27 in the present case are each formed by the respective flange or collar 24 or 25 fitted to the shaft 8, the two collars being spaced a certain distance apart. This makes it possible for the two springs 28 and 29 to be correspondingly far apart, which is constructionally advantageous. If desired, however, it will also be possible to have only one collar, whose two side surfaces could then form the rotation surfaces cooperating with the springs. A collar of this kind could be made integral with the shaft but it could also consist of a circular flange fitted around the shaft. It should be additionally mentioned that the two facing side surfaces of two collars can be used as rotation surfaces. It is, however, also possible to use a circular groove 33 in the shaft 8 instead of a collar to form a rotation surface. Thus, in the embodiment shown in FIG. 2, rotation surfaces 26 and 27 are formed by the two facing side surfaces of a circular groove cut in shaft 8. If, as here, the two rotation surfaces are opposite each other, the same function described above with two leaf springs can be performed with only one leaf spring. In the embodiment shown in FIG. 2, a leaf spring 34 is incorporated one end of which is clamped in wall 12 of assembly part 2 and which protrudes with its other, free end into the circular groove 33 in shaft 8, a pin 35 being inserted at right angles to the leaf spring 34 in this free end, which pin cooperates at one end with rotation surface 26 and at the other end with rotation surface 27. If the circular groove 33 is cut correspondingly narrow, a pin such as 35 may be omitted or the free end of the leaf spring could, by bending, etc., be so designed that it rests directly against rotation surfaces 26 and 27.

This method ensures that leaf spring 34 rests with its two side surfaces one on each side against and, in one of the two axial directions behind, one of the two rotation surfaces 26 and 27. In this way leaf spring 34 again ensures both the positioning of shaft 8, together with grinding wheel 9, in the desired idle position and the creation in both axial directions of a counter-force to a lateral grinding pressure on the grinding wheel in either of the axial directions.

As can be seen from the above, it is possible to make a number of variations of the embodiments described without exceeding the framework of the invention. That apples in particular to the formation of the rotation surface on the shaft with which the grinding wheel is integrally combined and also to the way in which the spring action is applied to the two rotation surfaces with at least one leaf spring.

What is claimed is:

1. Apparatus for sharpening knives, scissors, and similar cuffing devices, which comprises a housing forming an enclosure having two oppositely disposed walls each provided with an opening, said openings being coaxially aligned; a motor mounted on the outer side of one of said oppositely disposed walls, said motor having a shaft extending through the opening in said one wall into said enclosure; a second shaft extending through the opening in the other oppositely disposed wall; a grinding wheel fastened to the end of the second shaft positioned outside the enclosure; means for connecting the motor shaft to the other end of the second shaft to rotatably drive said second shaft and to enable axial movement of the motor shaft and the second shaft with respect to each other; a pair of axially spaced radial flanges mounted on the second shaft within the enclosure; a pair of axially spaced strip-shaped leaf springs for cooperation with said radial flanges and attached to the enclosure internally thereof, said radial flanges extend between said pair of leaf springs; and a cover associated with the housing and provided with a guide passage for drawing through a knife into contact with the grinding wheel, said knife when drawn through said guide passage exerting pressure on said grinding wheel and thereby moving the second shaft axially in one direction, whereby one of the radial flanges comes into contact with one of the leaf springs, said one leaf spring, following the drawing of the knife through said guide passage, axially moving the second shaft in an opposite direction.

2. Sharpening apparatus according to claim 1, in which the axial spacing between the leaf springs is greater than the axial spacing between the radial flanges.

3. Sharpening apparatus according to claim 1, in which the two limbs of a U-shaped strap form the pair of leaf springs, the portion of said U-shaped strap joining the two limbs being attached to the enclosure.

4. Sharpening apparatus according to claim 3, in which the free end of each limb is bent in a semi-circular shape.

* * * * *